US005261568A

United States Patent [19]

Corby et al.

[11] Patent Number: 5,261,568

[45] Date of Patent: Nov. 16, 1993

[54] APPARATUS FOR STORING AND DISPENSING PIGMENTED MARKING PARTICLES

[75] Inventors: Kenneth D. Corby; Vladimir Guslits; Jeffrey C. Robertson, all of Rochester; Kenneth J. Saunders, Leroy; Louis Root, Caledonia, all of N.Y.

[73] Assignee: Eastman Kodak Company, Rochester, N.Y.

[21] Appl. No.: 835,882

[22] Filed: Feb. 14, 1992

[51] Int. Cl.[5] ..... G03G 15/08

[52] U.S. Cl. ..... 222/167; 141/364; 222/DIG. 1; 222/325; 222/541; 355/260

[58] Field of Search ..... 222/165-167, 222/325, 541, DIG. 1; 206/816; 141/364; 355/245, 260

[56] References Cited

U.S. PATENT DOCUMENTS

| | | | |
|---|---|---|---|
| 4,441,636 | 4/1984 | Yamashita et al. | 222/541 |
| 4,478,512 | 10/1984 | Zoltner | 222/DIG. 1 X |
| 4,523,834 | 6/1985 | Pelda et al. | 355/260 |
| 4,627,476 | 12/1986 | Wilcke | 222/325 X |
| 4,688,926 | 8/1987 | Manno | 222/DIG. 1 X |
| 4,696,418 | 9/1987 | Kurotaka et al. | 222/325 X |
| 4,732,277 | 3/1988 | Smith | 222/DIG. 1 X |
| 4,740,808 | 4/1988 | Kasamura et al. | 355/260 |
| 4,778,086 | 10/1988 | Shibata et al. | 222/325 |
| 4,799,608 | 1/1989 | Oka | 222/DIG. 1 X |
| 4,827,307 | 5/1989 | Zoltner | 355/260 X |
| 4,869,401 | 9/1989 | Holtte et al. | 222/166 |
| 4,878,603 | 11/1989 | Ikesue et al. | 222/167 |
| 4,930,684 | 6/1990 | Patterson | 222/325 |
| 4,937,628 | 6/1990 | Cipolla et al. | 222/DIG. 1 X |
| 4,951,094 | 8/1990 | Bell et al. | 222/DIG. 1 |
| 4,969,557 | 11/1990 | Oka | 141/364 X |
| 5,030,998 | 7/1991 | Shibata et al. | 355/260 |
| 5,078,303 | 1/1992 | Kikuchi et al. | 222/325 X |
| 5,118,013 | 6/1992 | Mutou et al. | 222/DIG. 1 X |
| 5,142,335 | 8/1992 | Sakata et al. | 355/260 |
| 5,185,631 | 2/1993 | Shibata | 222/DIG. 1 X |

*Primary Examiner*—Kevin P. Shaver
*Attorney, Agent, or Firm*—Lawrence P. Kessler

[57] ABSTRACT

Apparatus for storing and dispensing pigmented marking particles into the development mechanism of a reproduction apparatus. The storing and dispensing apparatus comprises a cartridge including a housing for storing pigmented marking particles, and an elongated opening in the housing through which such marking particles may be dispensed. A cover is removably secured to the cartridge housing to seal the housing opening to prevent contamination of the environment by escape of such marking particles through the opening. The cover, in the preferred embodiment being a flexible sheet member, is selectively removed from sealing relation with the cartridge housing opening and held adjacent to the cartridge away from exposure to the environment when the cartridge is located relative to the development mechanism, whereby marking particles may readily be dispensed into the development mechanism through the housing opening and contamination of the environment is substantially prevented.

6 Claims, 5 Drawing Sheets

APPARATUS FOR STORING AND DISPENSING PIGMENTED MARKING PARTICLES

BACKGROUND OF THE INVENTION

The present invention relates in general to apparatus for storing and dispensing particulate matter, and more particularly to a apparatus for storing and dispensing pigmented marking particles for a reproduction apparatus.

In reproduction apparatus, such as electrostatographic copiers or printers, for example, a uniformly charged photoconductive member is exposed to a light image of information to be reproduced. Such exposure of the photoconductive member alters the uniform charge in an image-wise pattern forming a latent image charge pattern thereon. The charge pattern is then developed with pigmented marking particles from a development mechanism. The developed image is thereafter transferred to a receiver member and fixed to the receiver member to form the desired reproduction.

During development of the image-wise charge patterns to form the desired reproductions, the pigmented marking particles in the development mechanism are depleted and must be replenished. To accomplish marking particle replenishment, reproduction apparatus commonly have dispensers which periodically dump marking particles into the development mechanism. After some period of time, it is necessary to replenish the marking particles within the dispenser. Adding marking particles to the dispenser takes considerable care, since any spillage results in contamination, both to the immediate environment and to the surrounding area since the marking particles may easily become airborne. Further, the marking particles cling to the operator and his/her clothing, making replenishment a messy procedure.

It has long been desired to package the marking particles such that contamination of the reproduction apparatus, and the operator, are prevented. An example of a marking particle replenishment package is shown in U.S. Pat. No. 4,732,277, issued Mar. 22, 1988, in the name of Smith. Such replenishment package is in the form of an elongated cartridge defining a chamber for storing marking particles. A flexible sealing sleeve is removably secured to the cartridge to seal an elongated opening therein. The sleeve, adhered to the cartridge by adhesive material, has a pull strip positioned within and along the length of the sleeve. When the strip is pulled, the sleeve is peeled from the opening turning itself inside out. The cartridge is inserted into the reproduction apparatus with the sealing sleeve in place, and then the sleeve is removed. While this considerably reduces the potential for contamination, the sleeve itself may have marking particles adhering thereto which can cause contamination when the sleeve is removed.

Another marking particle package is shown in U.S. Pat. No. 5,030,998, issued Jul. 9, 1991, in the names of Shibata et al. In this apparatus of this patent, a seal member for a cartridge is attachable to a winding mechanism. The seal member is wound up by the winding mechanism whereby the cartridge is opened to enable the marking particles to be dispensed. However, the area of the seal member in contact with the marking particles is exposed such that airborne particles are free to escape and contaminate the environment.

SUMMARY OF THE INVENTION

This invention is directed to an apparatus for storing and dispensing pigmented marking particles for a development mechanism of a reproduction apparatus in which contamination is substantially prevented. The storing and dispensing apparatus comprises a cartridge including a housing for storing pigmented marking particles, and an elongated opening in the housing through which such marking particles may be dispensed. A cover is removably secured to the cartridge housing to seal the housing opening to prevent contamination of the environment by escape of such marking particles through the opening. The cover, in the preferred embodiment being a flexible sheet member, is selectively removed from sealing relation with the cartridge housing opening and held adjacent to the cartridge away from exposure to the environment when the cartridge is located relative to the development mechanism, whereby marking particles may readily be dispensed into the development mechanism through the housing opening and contamination of the environment is substantially prevented.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
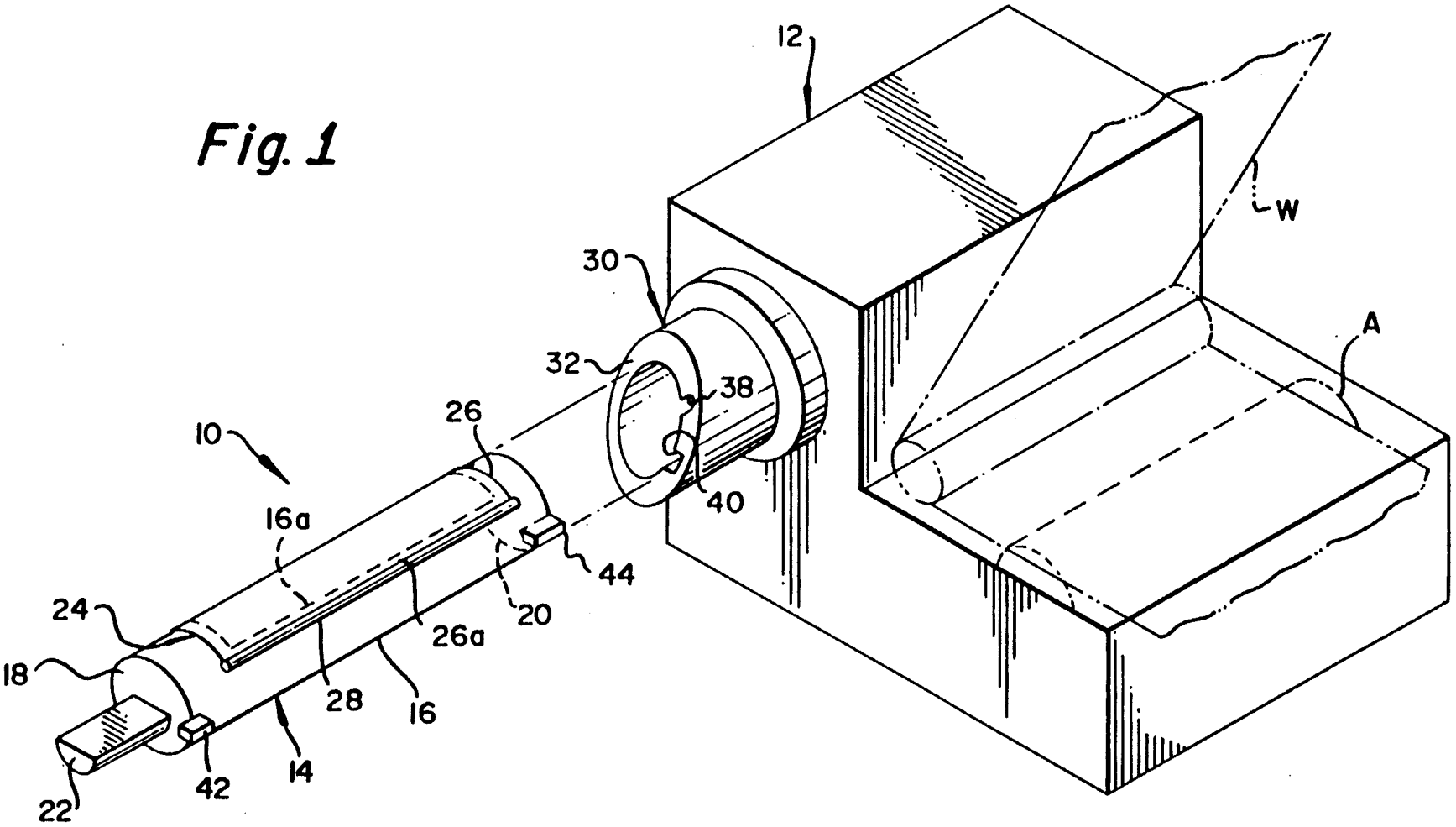
FIG. 1 is view, in perspective, of the apparatus for storing and dispensing pigmented marking particles, including a cartridge adapted to be associated with the development mechanism for a reproduction apparatus, according to this invention.

Referring now to the accompanying drawings, FIG. 1 shows an apparatus, designated generally by the numeral 10, for storing and dispensing particulate matter according to this invention. The particulate matter is, for example, pigmented marking particles which may be used in a development mechanism 12 of a typical reproduction apparatus. As is well known in the electrostatographic reproduction art, the pigmented marking particles in the development mechanism 12 serve to develop a latent image charge pattern on a dielectric member (shown in phantom as web W in FIG. 1) to form a visible, transferrable image thereon. On development of latent image charge patterns, the pigmented marking particles in the development mechanism 12 are depleted. The storing and dispensing apparatus 10 according to this invention serves, in the manner to be fully described hereinbelow, to enable the supply of pigmented marking particles in the development mechanism 12 to be replenished without contamination of the environment as was common with prior storing and dispensing apparatus.

The storing and dispensing apparatus 10 includes a cartridge 14. The cartridge 14 is constructed of a tubular housing 16 closed at each end by caps 18, 20 to form a storage chamber for pigmented marking particles therein. The housing 16 has an elongated slot 16*a* defined through a wall thereof. The slot 16*a* provides an opening which enables the housing chamber to be initially loaded with pigmented marking particles, and at a desired time, to have the particles dispensed therefrom. Further, a handle 22 is attached to the end cap 18 to facilitate handling of the cartridge 14.

A removable cover 24 is provided for the slot 16*a* of the cartridge housing 16. The cover 24 includes a flexible sheet member 26 of a size substantially larger than the slot 16*a*. A substantially rigid rod 28 is attached, in any well known manner, to a longitudinal marginal edge 26*a* of the flexible sheet member 26. Once the housing chamber of the cartridge 14 is loaded with pigmented marking particles, the flexible sheet member 26 is sealed about its marginal edges to the housing 16, by heat sealing or gluing for example, such that the sheet member completely covers the slot 16*a*. The sealing may take place along a straight line, or may be effected in any suitable V-shaped pattern for example, to establish the forces required to break the seal. With the flexible sheet member 26 sealed to the cartridge housing 16 in the described manner, escape of particles from the housing chamber, and resultant contamination, is substantially prevented. At this point, the rod 28 rests on the cartridge housing 16.

Figure 2A:
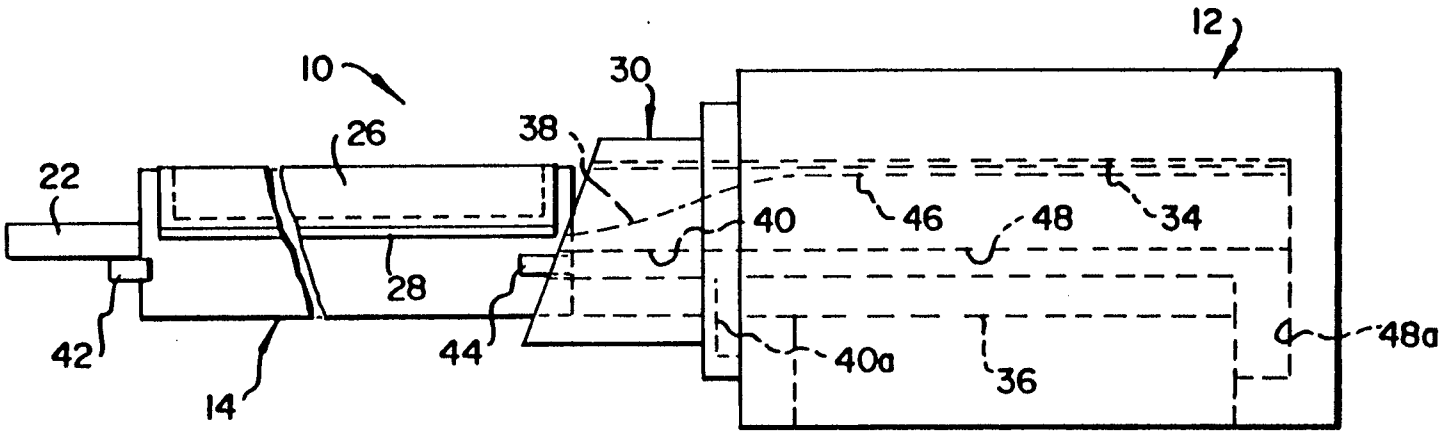
FIGS. 2*a* and 2*b* are side elevational views of a preferred embodiment of the apparatus for storing and dispensing pigmented marking particles according to this invention respectively showing the cartridge ready to be inserted into the development mechanism and the cartridge fully inserted into the development mechanism.
Figure 2B:
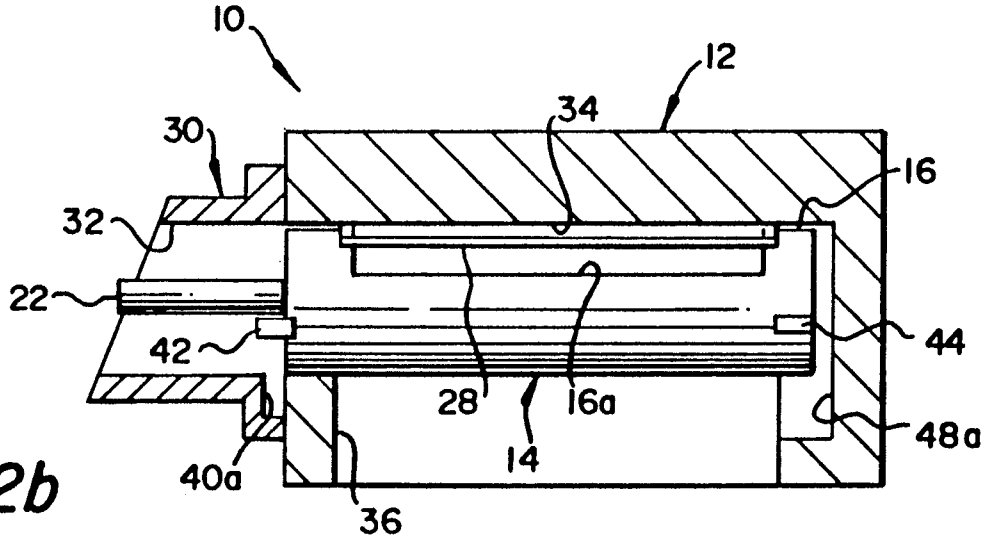

The development mechanism 12 has, attached thereto, a receiver 30 for the cartridge 14. The receiver 30 includes an orientation funnel 32 communicating with an internal chamber 34 (see FIGS. 2*a*, 2*b*). The internal chamber 34 defines an opening 36 through which pigmented marking particles are dispensed into a suitable feeder (not shown) where the particles are fed in any well known manner to an applicator A to develop a latent image charge pattern on the dielectric member web W. The orientation funnel 32 further includes a first slot 38 and a second slot 40. The first slot 38 is configured to receive rod 28 in a manner which accommodates for breaking of the seal of the flexible sheet member 26 to the cartridge housing 16 in a manner to fully explained below. Of course the rod 28 (and the accommodating slot 38) could be configured in any other suitable shape such as flat shim stock for example. The second slot 40 is configured to receive tabs 42 and 44, attached to the cartridge housing 16, to guide the cartridge 14 into the internal chamber 34 of the development mechanism 12 in proper orientation.

To carryout dispensing of the pigmented marking particles stored in the cartridge 14 into the development mechanism 12, the cartridge is manually oriented such that tab 44 on the cartridge housing 16 is aligned with the slot 40 of the orientation funnel 32. In such orientation, the rod 28 is aligned with slot 38 (see FIGS. 2*a*, 3, 6*a*). The cartridge 14 is then manually inserted into the funnel. As best shown in FIGS. 6*a*–6*d*, the slot 38 is configured to lift the rod 28 as it progressively enters the slot, and move the rod away from the housing 16 until the flexible sheet member 26 attached thereto is stripped from the cartridge housing 16 (i.e., the seal between the flexible sheet member and the cartridge housing is broken). At this point in time, the rod 28 is aligned with a slot 46 in the internal chamber 34 of the development mechanism 12, and the tab 44 is aligned with a slot 48 in such internal chamber. Continued insertion of the cartridge 14 into the internal chamber 34 serves to progressively break the seal between the flexible sheet member 26 and the housing 16, along the longitudinal marginal edge 26*a*. Such insertion continues until the tab 42, which extends radially from the housing 16 farther than tab 44, engages the front wall of the development mechanism 12 (see FIG. 2*b*). Such engagement serves as a locating stop for the cartridge. At this location, the cartridge 14 is fully inserted into the development mechanism 12, and is properly oriented with respect thereto.

It should be pointed out that slots 38 and 46 may have other suitable communicating configurations to accomplish the desired result of breaking the seal between the flexible sheet member 26 and the cartridge housing 16. That is, for example, the slots may comprise a communicating ramp sloping upwardly from the front of the orientation funnel 32 to the rear wall of the internal chamber 34 of the development mechanism 12. Such more gently sloping ramp configuration reduces the forces required to break the seal between the flexible sheet member 26 and the cartridge housing 16.

Figure 4:
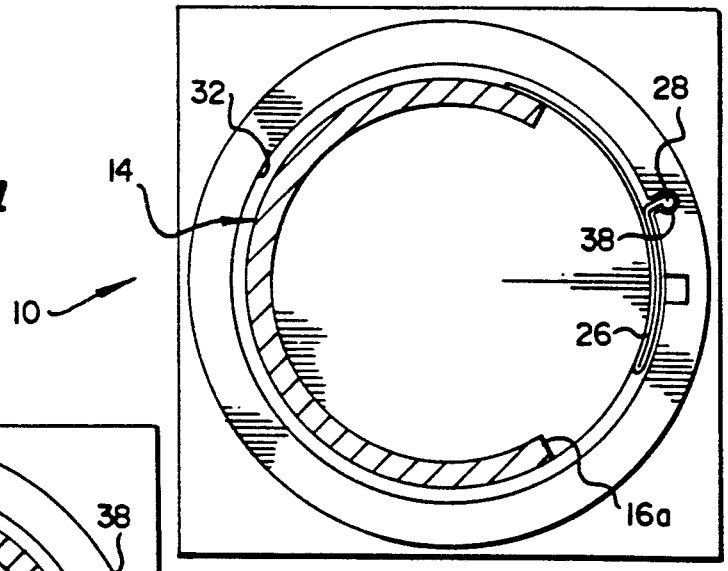
FIG. 4 is a front elevational view, similar to FIG. 3, of the apparatus for storing and dispensing pigmented marking particles showing the cartridge in an intermediate orientation between its loading position and its dispensing position.

With the cartridge 14 fully inserted into the development mechanism 12, tab 44 is aligned with an annular slot 48*a* in the internal chamber, and the tab 42 is aligned with an annular slot 40*a* in the orientation funnel 32. Tab 44 (and its associated annular slot 48*a*) is longer in the longitudinal direction than tab 42 (and its associated annular slot 40*a*). In this manner, on insertion of the cartridge 14 into the development mechanism, tab 44 cannot enter the annular slot 40*a* and premature rotation of the cartridge is thereby prevented. As a result of the respective tab/slot alignments, the cartridge 14 is free to rotate in the internal chamber 34. The handle 22 for the cartridge 14 is then manually rotated (in a clockwise direction in the drawings). Since the rod 28 is captured in the slot 46, on rotation of the cartridge, the flexible sheet member 26 is peeled back (see FIG. 4).

Figure 3:
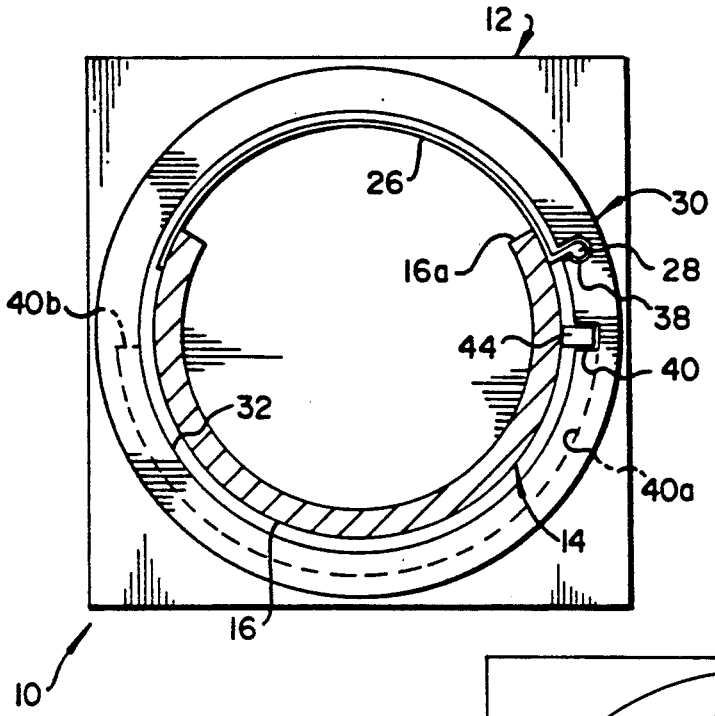
FIG. 3 is a front elevational view, on an enlarged scale, of the apparatus for storing and dispensing pigmented marking particles of FIG. 1.
Figure 5:
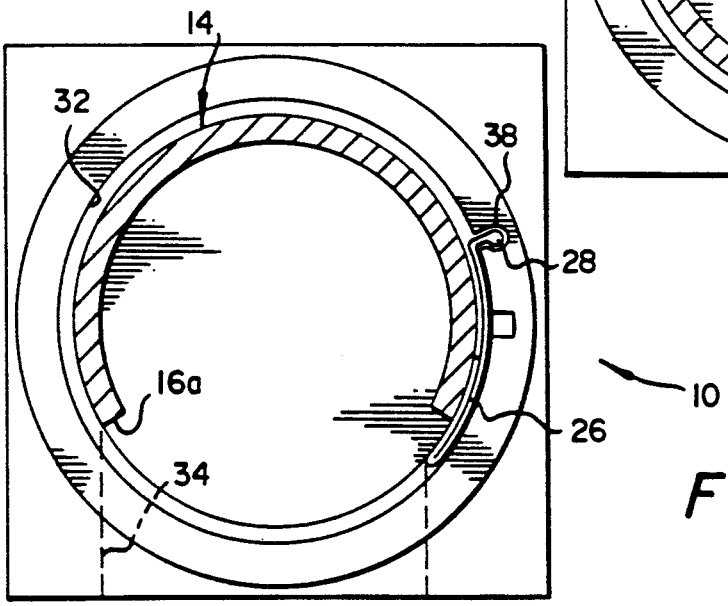
FIG. 5 is a front elevational view, similar to FIG. 3, of the apparatus for storing and dispensing pigmented marking particles showing the cartridge in its dispensing position.
Figure 6A:
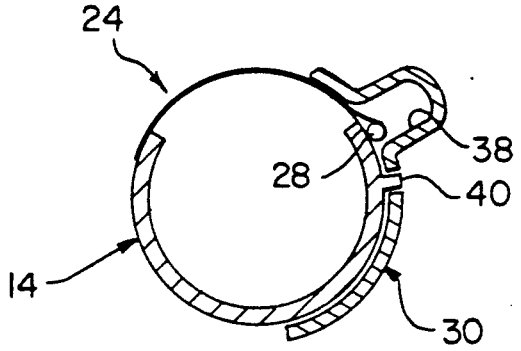
FIGS. 6*a*–6*d* are front elevational views respectively showing the progressive movement of the rod for removing the cartridge cover.
Figure 6B:
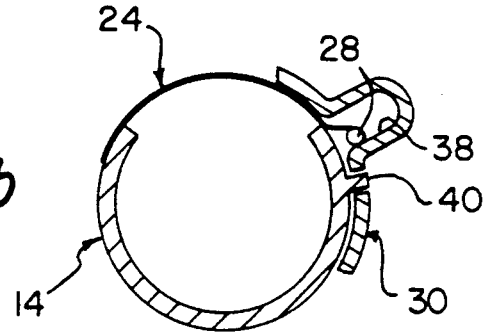
Figure 6C:
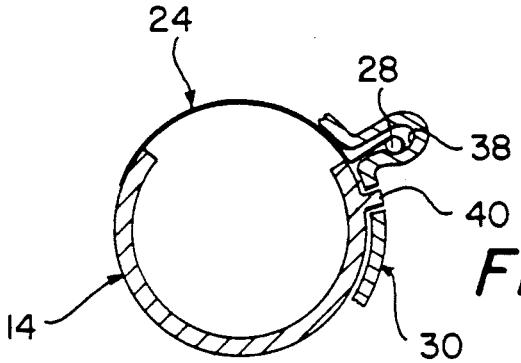
Figure 6D:
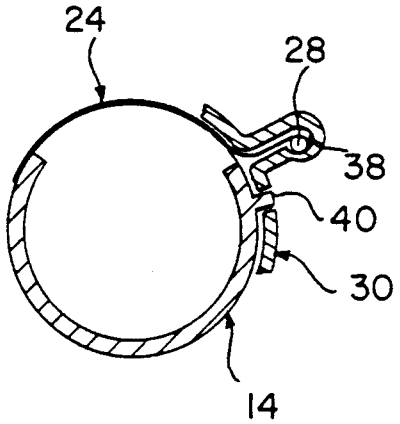

The manual rotation of the cartridge 14 continues until the cartridge has reached the position shown in FIG. 5 where the tab 42 engages the end wall 40*b* (stop) of the annular slot 40*a* (substantially 180° from the position shown in FIG. 3). At this point, the flexible sheet member 26 completely uncovers the opening 16*a* in the cartridge housing. Further, the opening 16*a* overlies the opening 36 in the internal chamber 34 of the development mechanism 12. Accordingly, the pigmented marking particles stored in the cartridge 14 are free to be dispensed into the development mechanism 12. Since the flexible sheet member 26 is spaced from the opening 34, and is shielded by its location between the cartridge housing 16 and the wall of the internal chamber 34, contamination of the flexible sheet member is substantially prevented.

After the pigmented marking particles have been dispensed from the cartridge 14 into the development mechanism 12, at any desired time, the cartridge can be removed from the development mechanism, by simply reversing the above described insertion procedure. That is, the handle 22 of the cartridge is manually rotated in the opposite direction (counter-clockwise) substantially 180° to return the cartridge to the position shown in FIG. 3, from the position shown in FIG. 5. At such position, the tabs 42 and 44 align with the slots 48 (in the internal chamber 34 of the development mechanism 12) and 40 (in the orientation funnel 32). The cartridge 14 can then be readily removed from the internal chamber 34. It is of course clear that, on return rotation of the cartridge 14, the flexible sheet member 26 is returned to its position covering the housing opening 16*a*. In this manner, when the cartridge is removed from the development mechanism 12, repositioning of the flexible sheet member to cover the opening 16*a* assures that contamination will further be prevented.

Figure 7:
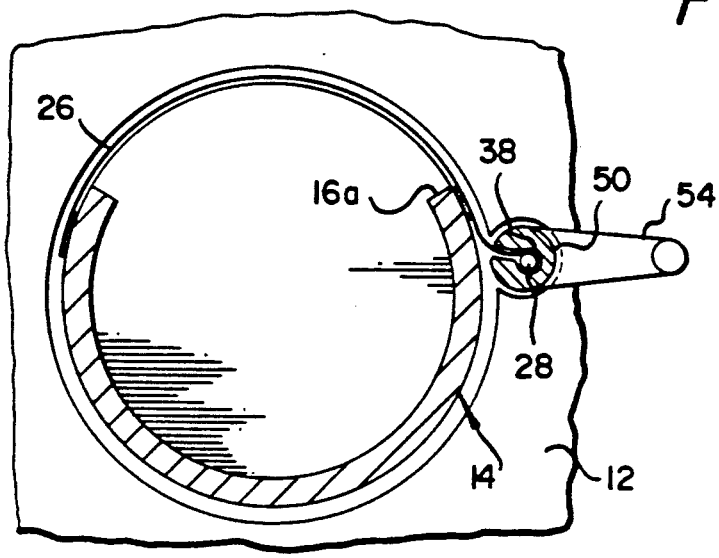
FIG. 7 is a side elevational view of an alternate embodiment of the apparatus for storing and dispensing pigmented marking particles according to this invention.
Figure 8:
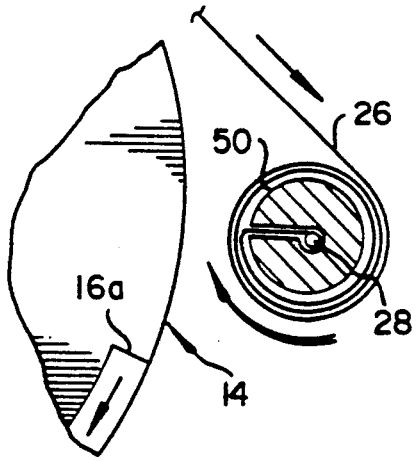
FIG. 8 is a front elevational view showing the cartridge cover removal mechanism, of the alternate embodiment of the apparatus of FIG. 7, at an intermediate stage of cover removal.

Referring now to FIG. 7, an alternate embodiment, designated by the numeral 110, of the arrangement for removing the flexible sheet member 26 as the cover 24 for the housing opening 16*a* of the cartridge 14 is shown. In place of the slot 46 of the internal chamber 34 of the development mechanism 12 (as shown in FIGS. 1 through 6*a*–6*d*), there is provided a slot 46', extending the full length (in the longitudinal direction) of the internal chamber. A rotatable element 50 having a slot 52 adapted to receive the rod 28 of the cartridge 14 is located in the slot 46'. A handle 54 is connected to the element 50 for selectively rotating such element in the slot 46'. When the cartridge 14 is inserted into the orientation funnel 32, the rod 28 is positioned to enter the slot 52 of the rotatable element 50. Then, rotation of the element 50 by the handle 54 breaks the seal between the flexible sheet member 26 and winds the flexible sheet member up about the element (see FIG. 8).

Of course in the embodiment 110, rotation of the element 50 may be manually induced, or may be effected by coupling any suitable power winding mechanism (not shown) to the handle 54 or directly to the element 50. As the element 50 is rotated, the housing 16 of the cartridge 14 is rotated in the chamber 34 until the opening 16*a* overlies the opening 36 of the internal chamber 34. The opening 16*a*, when overlying the opening 36, is fully uncovered, and the pigmented marking particles are dispensed from the cartridge 14 therethrough.

Figure 9:
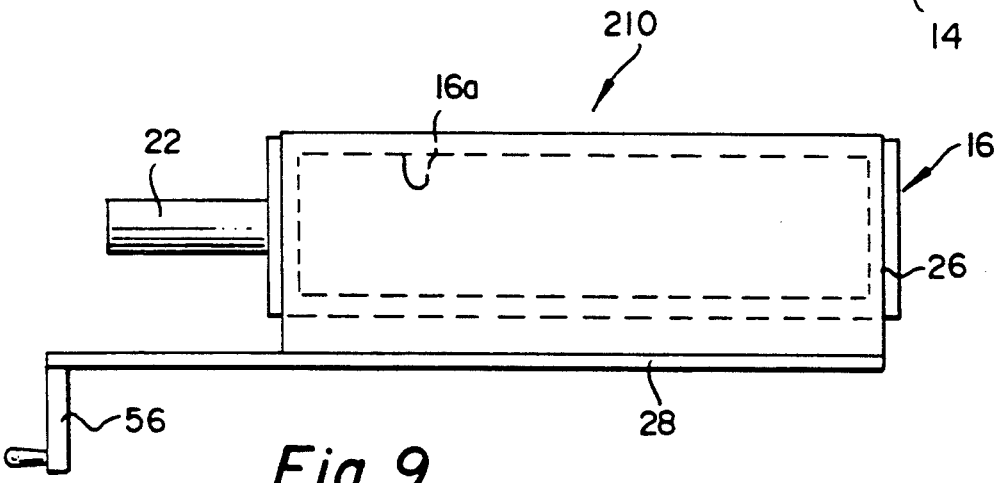
FIG. 9 is a top plan view of still another alternate embodiment of the apparatus for storing and dispensing pigmented marking particles according to this invention.

FIG. 9 shows another alternate embodiment, designated by the numeral 210, of the storing and dispensing apparatus 10 according to this invention. This embodiment is similar to the embodiments of FIGS. 7 and 8 except the rotatable element 50 and the handle 54 thereof is replaced by a handle 56 connected directly to the rod 28. With this arrangement, rotation of the handle 56 causes the rod 28 to rotate, and the flexible sheet 26 is wound up directly about the rod. The operation for uncovering the opening 16*a* of the cartridge housing 16 and rotating the cartridge to the marking particle dispensing position is the same as described immediately above relative to the operation of the embodiment 110 of FIGS. 7 and 8.

Figure 10:
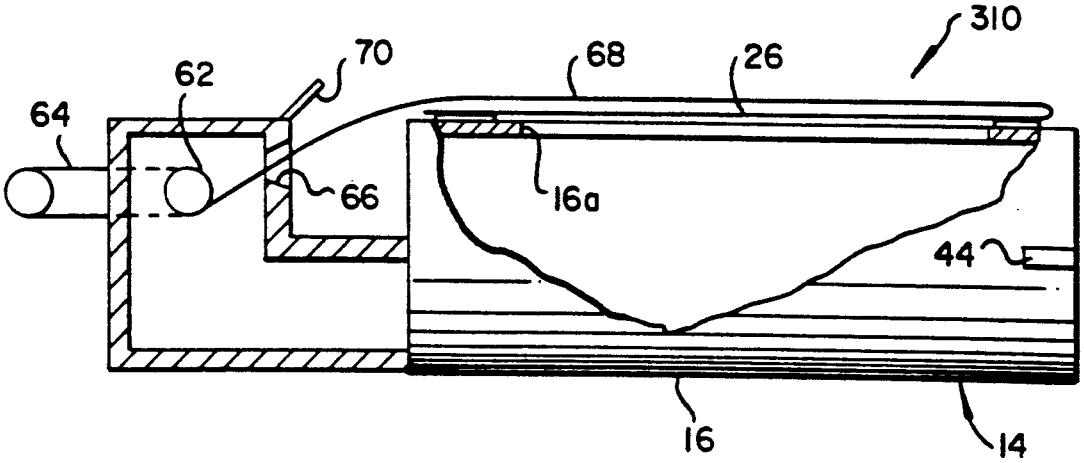
FIG. 10 is a side elevational view of yet another alternate embodiment of the apparatus for storing and dispensing pigmented marking particles according to this invention.

A yet another embodiment, designated by the numeral 310, of the storing and dispensing apparatus 10 according to this invention is shown in FIG. 10. In this embodiment, the cartridge 14 includes a housing assembly 60 attached to the end of the cartridge extending outwardly from the development mechanism 12 (when the cartridge is positioned within the development mechanism). The housing assembly 60 includes a winding shaft 62 rotatably supported within the housing assembly. A readily accessible crank 64 is attached to one end of the winding shaft 62. The housing assembly 60 has a guide slot 66 located between the cartridge housing 16 and the winding shaft 62. The flexible sheet member 26 includes a portion 68 extending from the far marginal edge thereof, directed through the guide slot 66, attached to the winding shaft 62. A shield 70, attached to the housing assembly 60, overlies a portion of the path of the flexible sheet member portion 68*as* it enters the guide slot 66. With this arrangement, when the cartridge 14 is positioned within the internal chamber 34 of the development mechanism 12, the crank 64 may be rotated (again, manually or by any suitable motive mechanism) to wind up the flexible sheet member 26 on the shaft 62 to uncover the opening 16*a* of the cartridge housing 16. The shield 70 prevents contamination of the environment by airborne marking particles when the flexible sheet member is wound on the winding shaft. Once the flexible sheet member 26 is wound on the winding shaft 62, the cartridge 14 can be rotated as described above to orient the housing opening 16*a* in alignment with the opening 36 of the internal chamber 34, and the pigmented marking particles within the cartridge can be similarly dispensed into the development mechanism 12.

The invention has been described in detail with particular reference to preferred embodiments thereof, but it will be understood that variations and modifications can be effected within the spirit and scope of the invention as set forth in the claims.

What is claimed is:

1. In combination, a development mechanism of a reproduction apparatus and apparatus for storing and dispensing pigmented marking particles into said development mechanism, said combination comprising:

a cartridge including a housing for storing pigmented marking particles, said cartridge housing defining an elongated opening through which such marking particles may be dispensed;

a cover, removably secured to said cartridge housing, for sealingly covering said opening when secured to said housing to prevent contamination of the environment by escape of such marking particles through said opening, said cover including a flexible sheet member, and a substantially rigid member attached to said flexible sheet member outside of the area where said flexible member is secured to said cartridge housing; and cover removing means for selectively removing said cover, at least partially, from sealing relation with said housing opening and holding said cover adjacent to said cartridge away from exposure to the environment when said cartridge is located relative to said development mechanism, whereby marking particles may readily be dispensed into said development mechanism through said housing opening and contamination of the environment is substantially prevented, said cover removing means including an orientation funnel associated with said development mechanism, said orientation funnel defining a slot, extending along the length thereof, for receiving said substantially rigid member as said cartridge is inserted through said orientation funnel to said development mechanism, said slot being defined to have a shape so as to move said substantially rigid member in a direction away from said cartridge housing, as said cartridge housing is inserted through said orientation funnel, a distance sufficient to break the seal between said flexible sheet member attached to said substantially rigid member and said housing.

2. The combination of claim 1 wherein said substantially rigid member is a rod attached to a marginal edge of said flexible sheet member outside of the area where said flexible member is secured to said cartridge housing.

3. The combination of claim 2 wherein said cartridge includes a handle attached to the housing thereof for facilitating rotation of said cartridge relative to said orientation funnel, and wherein said slot of said orientation funnel holds said rod during rotation of said cartridge by said handle so that said flexible sheet member is located adjacent to said cartridge housing but said opening thereof is uncovered.

4. The combination of claim 3 wherein said cartridge housing has at least one tab extending substantially radially therefrom, and said orientation funnel further defines an additional slot substantially complementary to said cartridge housing tab, whereby when said tab is aligned with said additional slot, said additional slot receives said tab to properly locate said cartridge relative to said development mechanism, and locate said rod attached to said flexible sheet member relative to said first mentioned slot of said orientation funnel.

5. Apparatus, in combination with the development mechanism of a reproduction apparatus, for storing and dispensing pigmented marking particles into said development mechanism, said combination comprising:

a cartridge including a substantially tubular elongated housing for storing pigmented marking particles, said cartridge housing defining an elongated opening through which such marking particles may be dispensed;

a cover, removably secured to said cartridge housing, for covering said elongated opening when secured to said housing to seal said housing opening and prevent contamination of the environment by escape of such marking particles through said opening, said cover including a flexible sheet member, and a substantially rigid member attached to said flexible sheet member outside of the area where said flexible member is secured to said cartridge housing;

at least one tab extending substantially radially from said cartridge housing;

means, associated with said development mechanism for receiving said cartridge, said cartridge receiving means including a first slot substantially complementary to said cartridge housing tab, whereby when said tab is aligned with said first slot, said first slot receives said tab to properly locate said cartridge relative to said development mechanism; and cover removing means for selectively removing said cover, at least partially, from sealing relation with said housing opening and holding said cover adjacent to said cartridge away from exposure to the environment when said cartridge is located relative to said development mechanism, whereby making particles may readily be dispensed into said development mechanism through said housing opening and contamination of the environment is substantially prevented, said cover removing means including an orientation funnel associated with said development mechanism, said orientation funnel defining a second slot, extending along the length thereof, for receiving said substantially rigid member as aid cartridge is inserted through said orientation funnel to said cartridge receiving means, said second slot being defined to have a shape so as to move said substantially rigid member in a direction away from said cartridge housing, as said cartridge housing is inserted through said orientation funnel, a distance sufficient to break the seal between said flexible sheet member attached to said substantially rigid member and said housing.

6. The combination of claim 5 wherein said cartridge includes a handle attached to the housing thereof for facilitating rotation of said cartridge relative to said receiving means, and wherein said second slot of said orientation funnel holds said substantially rigid member during rotation of said cartridge by said handle so that said flexible sheet member is located adjacent to said cartridge housing but said opening thereof is uncovered.

* * * * *

UNITED STATES PATENT AND TRADEMARK OFFICE

CERTIFICATE OF CORRECTION

PATENT NO. : 5,261,568

DATED : November 16, 1993

INVENTOR(S) : Kenneth D. Corby, et al

It is certified that error appears in the above-indentified patent and that said Letters Patent is hereby corrected as shown below:

| | |
|---|---|
| Column 8, line 28 | Delete "making" and substitute ---marking---. |

Signed and Sealed this

Seventh Day of February, 1995

*Attest:*

*Attesting Officer*

BRUCE LEHMAN

*Commissioner of Patents and Trademarks*